US007168473B2

(12) United States Patent
Geus et al.

(10) Patent No.: US 7,168,473 B2
(45) Date of Patent: Jan. 30, 2007

(54) APPARATUS FOR MAKING A NONWOVEN SYNTHETIC-RESIN WEB OR FLEECE

(75) Inventors: Hans-Georg Geus, Niederkassel-Rheidt (DE); Detlef Frey, Niederkass I-Rheidt (DE)

(73) Assignee: Reifenhauser GmbH & Co. Maschinenfabrik, Troisdorf (DE)

( * ) Notice: Subject to any disclaimer, the term of this patent is extended or adjusted under 35 U.S.C. 154(b) by 378 days.

(21) Appl. No.: 10/684,257

(22) Filed: Oct. 10, 2003

(65) Prior Publication Data

US 2004/0121673 A1 Jun. 24, 2004

(30) Foreign Application Priority Data

Dec. 19, 2002 (EP) ..... 02028455

(51) Int. Cl.
*B65H 20/14* (2006.01)

(52) U.S. Cl. ..... 156/441; 156/181; 425/80.1; 425/131.5; 425/192 S; 271/6; 271/7; 271/12; 271/69

(58) Field of Classification Search ..... None
See application file for complete search history.

(56) References Cited

U.S. PATENT DOCUMENTS 5,031,280 A * 7/1991 Demuth ..... 19/200
6,096,668 A * 8/2000 Abuto et al. ..... 442/328
6,784,125 B1 * 8/2004 Yamakawa et al. ..... 442/328

* cited by examiner

*Primary Examiner*—Sam Chuan Yao
(74) *Attorney, Agent, or Firm*—Andrew Wilford

(57) ABSTRACT

A web or fleece of synthetic resin strand collected on a sieve belt is discharged from the sieve belt into further processing equipment over a rerouting roller at the discharge end of the sieve belt. The rerouting roller is perforated and air or another fluid medium is passed through the belt at the rerouting roller to reduce adhesion forces between the belt and the web and lift the web from the belt without damage to the belt.

8 Claims, 3 Drawing Sheets

APPARATUS FOR MAKING A NONWOVEN SYNTHETIC-RESIN WEB OR FLEECE

FIELD OF THE INVENTION

Our present invention relates to an apparatus for making synthetic resin strand webs and, especially nonwoven webs or fleeces, to a method of making a web or a method of operating the apparatus and, in particular, to an apparatus for depositing the web and conveying the deposited web.

BACKGROUND OF THE INVENTION

In the production of nonwoven webs from synthetic resin strands it is customary to deposit the strands so that they intermingle upon a roving surface, usually a conveyor belt which is foraminous, i.e. permeable to a gas and below which a suction may be applied to assist in the formation of the web of intermingled strands. The web is conveyed away from the site at which it is formed on the conveyor belt and may be subject to further processing, such as calendering between at least one pair of rolls after the web has been removed or discharged from the belt.

The strands which form the web or fleece are synthetic resin threads which can be continuous or discontinuous. A continuous synthetic resin thread can be a continuous thermoplastic synthetic resin filament extruded from a spinneret. The strands may also be discrete fibers, i.e. extruded filaments which are subdivided upon forming. In general the webs can be formed by either the spun-bond process from such continuous filaments or by the melt-blown process from short fibers and are frequently referred to as mats or fleeces. The products made by the melt-blown and spun-bond processes may be used as sanitary pads, diapers, disposable hygienic garments and the like or as fabrics to be impregnated with synthetic resin or other materials as reinforcements for structural layers or as liners or supports for a variety of finished products.

As a general matter, the foraminous belt, also referred to a sieve belt or a suction belt since a suction is often drawn from below the belt for deposit of the web, receives the unconsolidated mass of intermingled strands. The strands may be hot and thus may fuse together at contact points or crossing points and may consolidate somewhat on cooling. In general, however, the more or less unconsolidated fleece or web is carried by the belt over a rerouting roller at which the belt is deflected from its upper pass to a return pass and the web, no longer supported by the belt, is withdrawn therefrom. The removal of the web from the belt sometimes requires the application of a longitudinal force to the web, this force being applied by the processing equipment downstream of the rerouting roller at the end of the upper pass of the belt. This force may be excessive and, especially with high speeds of web formation and transfer or reduced area weight (weight of the web per unit area) and web density, the forces which may be applied to the web at the discharge end of the conveyor can result in damage to the web, reduction in web quality, a varying transverse contraction of the web and injury to the edges of the web. In extreme cases the web may be torn and damage of this type can give rise to interruption in the web-producing process, especially if the web tends to be entrained onto the return pass of the belt.

OBJECTS OF THE INVENTION

It is, therefore, the principal object of the present invention to provide an apparatus for the formation of such webs and fleeces whereby these drawbacks cannot arise and which is therefore more reliable and especially can ensure a more effective removal of the web from its conveying belt.

Another object of the invention is to provide an apparatus for the purposes described which can prevent the application of excessive force to a web or fleece upon its removal from the deposition belt and thereby preclude damage to the web or the danger that a portion of the web will be entrained on the return pass of the belt.

It is also an object of this invention to provide a method of operating an apparatus of the type described so as to minimize possible damage to the web or to the edges thereof upon the transfer of the web from the web-laying belt to further processing equipment.

It is also an object of this invention to provide an improved method of making a web or fleece from synthetic resin strands and an apparatus for that purpose whereby the drawbacks of earlier systems can be avoided.

SUMMARY OF THE INVENTION

These objects are attained, in accordance with the invention, in an apparatus for forming a nonwoven web or fleece which comprises:

an endless foraminous belt passing over at least two rollers and having an upper pass between the rollers at which a nonwoven web is formed on the belt;

a device for depositing strands on the belt upstream of one of the rollers to form the web on the belt by intermingling of the strands, the one of the rollers being hollow and formed on a periphery thereof with fluid-discharge openings distributed over the periphery; and a source of a fluid medium connected to the interior of the one of the rollers for feeding the fluid medium to the one of the rollers whereby the fluid medium passes through the openings and the belt and lifts the web from the belt.

The apparatus for the laying down of a nonwoven web or fleece of synthetic resin strands and conveying the fleece or web comprises, therefore, an endlessly circulating web-laying sieve belt which passes over rollers and on which the strands are deposited to form the web. A first roller beneath the belt is formed over its roller shell of outlet openings which are mutually spaced apart and can be uniformly distributed and from which a fluid motor from the interior of the roller is discharged through the belt and lifts the web from the belt from below.

As noted, the strands which are deposited in accordance with the invention can be theoretically endless filaments or filaments which have been subdivided, i.e. synthetic resin threads in the form of short fibers.

According to a feature of the invention in the deposition region, i.e. the region in which the strands are laid onto the belt, a suction device together with a suction shaft can be provided below the sieve belt. This suction device serves to draw process air through the fleece or web as it is being formed and the sieve belt and thereby reliably draws the strands together to form the web. Of course that means that the sieve belt will be permeable to the process air which is drawn therefrom. As a general matter the sieve belt will be permeable to fluid media.

When reference is made herein to the engagement of the mat, fleece or web by a fluid medium from below, we intend to indicate thereby that the fluid medium, usually air, from the roller provided with the perforations in its shell is directed upwardly from beneath the web to lift it from the belt. The supply of the fluid medium from beneath the web reduces the forces which hold the web onto the belt and ensures a reliable and simple transfer of the web to the subsequent processing equipment.

This first roller can be a rerouting roller about which the belt is deflected form its upper pass onto the return pass. The upper pass is usually a horizontal pass.

In general, downstream of the first roller, a further conveying and/or processing unit is provided for the fleece or nonwoven web and can receive the latter form the belt. The fluid medium can lift the web slightly upon leaving the belt and assist in delivering it to the further processing equipment which can include, as has been noted, at least one pair of calendering rolls. Of course the further conveying and processing equipment can include another conveyer belt.

The web-lifting fluid medium is preferably a gas and, most advantageously, compressed air.

When we refer to a perforated first roller, we intend to indicate that the shell of this hollow roller can be provided with uniformly distributed outlet openings, preferably small openings, from which compressed air emerges with a sufficient force to penetrate the belt and lift the web in the manner described. The shell of the roller can be cylindrical and the roller can have a stub which is hollow and communicates with the interior of the roller to deliver the compressed air thereto. When the roller rotates at a speed which is sufficient, the rotation of the roller may draw air into it and dispense the air through the perforations. In general the perforations should be radial orifices, enabling the radial discharge of the air. In a preferred embodiment, the fluid medium emerges exclusively as a result of the centrifugal force produced by the return of the roller and the air is sucked into the perforated roller through the hollow shaft. Of course both a blower supplying the air and centrifugal force can be used to displace the web-lifting air.

Preferably a baffle arrangement is provided in the interior of the roller and directs the flow of the fluid medium toward the web lying upon the belt. The baffle may include a sheet metal baffle member which may be provided along an inner wall of the roller to block the outflow in directions other than the desired outflow direction. The interior of the roller can be provided with an inner stator which may extend parallel to the roller shell and its inner stator or baffle can extend over at least 50% and preferably at least 75% of the periphery of the roller.

The roller may be connected to a device for conditioning the air, for example, to achieve a predetermined air moisture content.

The apparatus of the invention provides a very simple and reliable transfer of the nonwoven mat or fleece from the depositing sieve belt to the further processing unit, for example, the calender to the forces applied to the web are reduced and possible detriment to web quality is eliminated. The production of nonwoven web is simplified and made less expensive.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
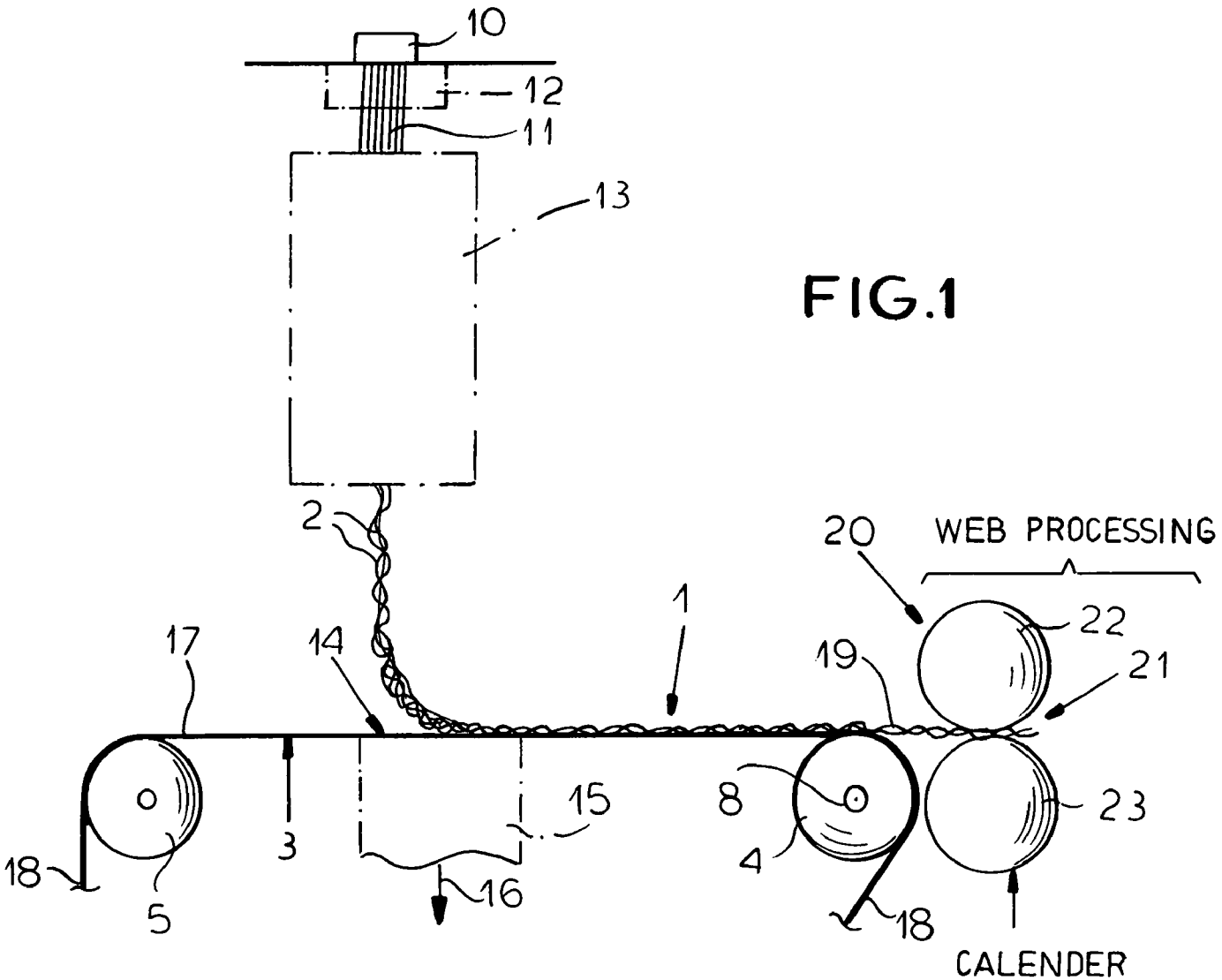
FIG. 1 is a diagrammatic side elevational view of an apparatus according to the invention.

In FIG. 1 we have shown an apparatus for the production of a nonwoven web or fleece 1 from synthetic resin strands which may be continuous thermoplastic filaments or a curtain of synthetic resin thermoplastic fibers derived originally from a spinneret 10 from which synthetic resin strands are extruded at 11. In the case of a melt-blown web, air is directed at the strand at 12 to subdivide the extruding stream of synthetic resin into short lengths forming fibers. The fibers or continuous monofilaments are cooled in the region 13 and in the case of spun bond continuous filaments, are stretched before they are intermingled in the curtain of strands 2 which collect upon the upper surface of a sieve belt 3 which is also referred to as a laying or depositing belt. Below the region 14 in which the strands are deposited, there may be a suction column 15 through which process air is withdrawn by a suction pump as represented at 16.

The belt 3 is an endless belt whose upper horizontal pass is shown at 17 and spans between a first roller 4 and a second roller 5. The rollers 4 and 5 are rerouting rollers located between the horizontal pass 17 and the return pass 18 which has not been shown in total. At the rerouting roller 4, therefore, the belt 3 is deflected downwardly and the web 1, separated at 19 can pass into a transport and processing unit downstream of the web-forming unit and represented at 20. This unit can include at least one calendering unit 1 formed by an upper roll 22 and a lower roll 23.

Figure 2:
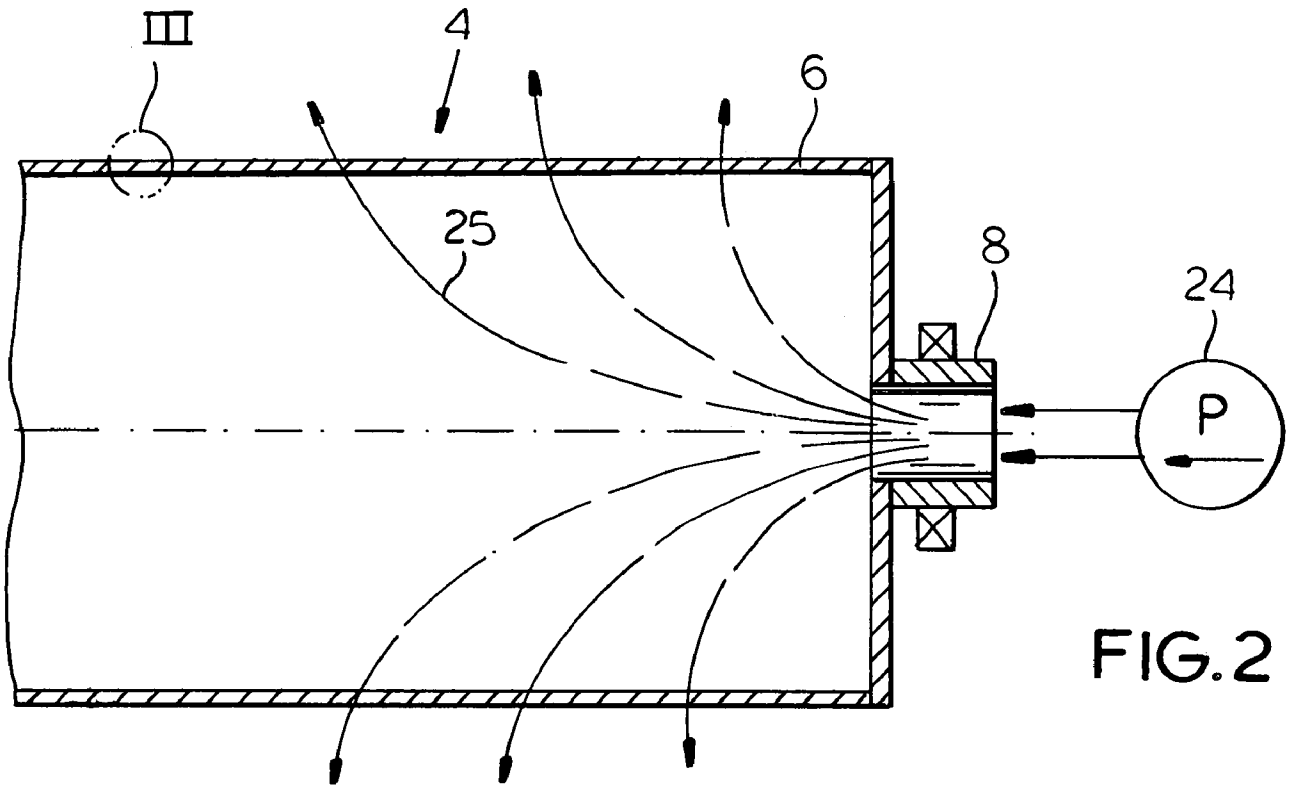
FIG. 2 is a section through the perforated rerouting roller of the invention.

According to the invention and as shown in FIG. 2, the rerouting roller 4 comprises a cylindrical roller shell 6 forming with radial outlet openings 7 distributed over its entire periphery.

The outlet openings 7 serve to discharge a fluid medium, usually air. This fluid medium passes through the sieve belt 3 and is directed against the web 1 from below and thus lifts the web 1 and reduces any retention forces between the web 1 and the belt 3 to ensure a simple and reliable separation of the web 1 from the belt. In the drawing the flow direction of the fluid medium, i.e. the air, has been indicated by arrows.

Figure 3:
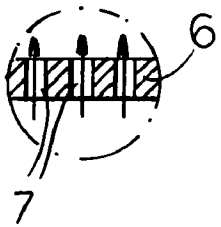
FIG. 3 is a detail of the region III of FIG. 2.

As can be seen from FIG. 2, a pump or blower (compressor) 24 can be provided to supply air through the hollow stub shaft 8 in which the roller 4 is journaled to force air out through the perforations 7 as represented by the arrow 25. Alternatively, air may be drawn in through the shaft 8 and discharged through the opening 7 by centrifugal force from return of the roller 4. The entire shell 6 can be provided with small openings 7 as has been illustrated in FIG. 3.

Figure 4:
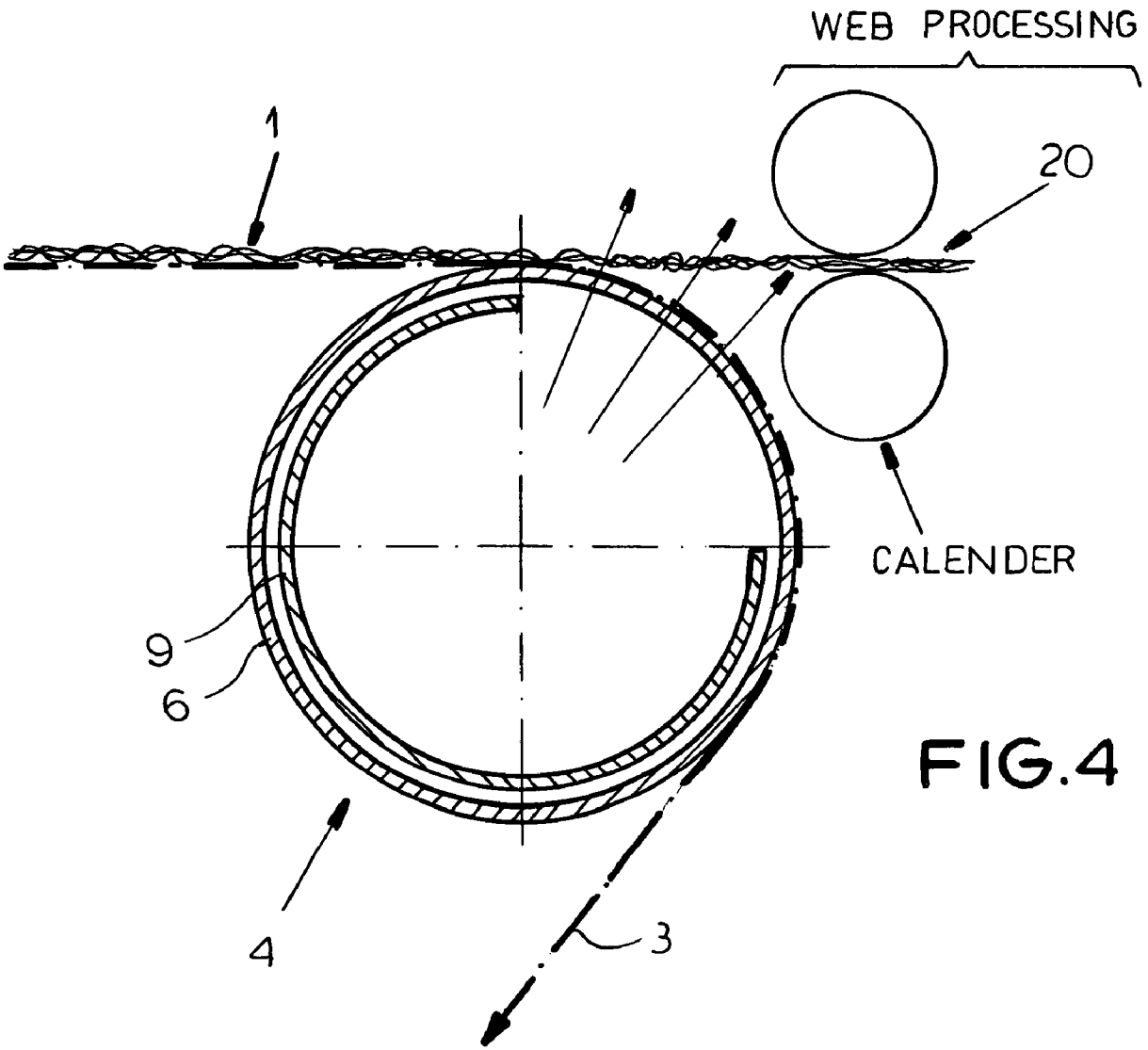
FIG. 4 is an enlarged vertical section through the apparatus of FIG. 1 illustrating a second embodiment.

FIG. 4 shows that within the interior of the roller 4 a baffle 9 can be provided to restrict the fluid medium outflow to the upper right-hand quadrant of the roller 4, i.e. the region at which the belt 3 is deflected from the web as the web passes into the calender 20. The baffle 9 is advantageously a sheet metal partial cylindrical member that can extend over 75% of the inner periphery of the shell 6 if desired.

We claim:

1. An apparatus for forming a nonwoven web, the apparatus comprising:

an endless foraminous belt passing over at least two rollers and having an upper pass between said rollers;

means including a spinneret for depositing strands on the upper pass of said belt upstream of one of said rollers to form a web on said belt by intermingling of said strands, said one of said rollers being hollow and formed on a periphery thereof with fluid-discharge openings distributed over said periphery;

a web-conveying and processing device immediately downstream of the one roller; and means including a source of a fluid medium connected to said interior of said one of said rollers for feeding said fluid medium to said one of said rollers such that the fluid medium passes through said openings and through said belt and lifts said web from said belt at the one roller and upstream of the web-conveying and processing device.

2. The apparatus defined in claim 1 wherein said one of said rollers is a rerouting roller at a discharge end of said upper pass.

3. The apparatus defined in claim 1 wherein said web-conveying or processing device includes at least one calender for said web.

4. The apparatus defined in claim 3 wherein said fluid medium is a gas.

5. The apparatus defined in claim 4 wherein said gas is air.

6. The apparatus defined in claim 5 wherein said one of said rollers has a perforated cylindrical shell.

7. The apparatus defined in claim 6 wherein said one of said rollers has a hollow shaft stub with which said one of said rollers is journaled for rotation, said hollow shaft stub being connected to said source to admit said fluid medium to said shell.

8. The apparatus defined in claim 7, further comprising a baffle in said one of said rollers directing flow of said fluid medium toward said belt and said web.

* * * * *